US007365312B2

(12) United States Patent
Laskin et al.

(10) Patent No.: US 7,365,312 B2
(45) Date of Patent: Apr. 29, 2008

(54) METHOD AND APPARATUS FOR ENHANCED SEQUENCING OF COMPLEX MOLECULES USING SURFACE-INDUCED DISSOCIATION IN CONJUNCTION WITH MASS SPECTROMETRIC ANALYSIS

(75) Inventors: Julia Laskin, Richland, WA (US); Jean H. Futrell, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 11/605,881

(22) Filed: Nov. 29, 2006

(65) Prior Publication Data

US 2007/0114390 A1 May 24, 2007

(51) Int. Cl.
*H01J 49/00* (2006.01)

(52) U.S. Cl. ..... 250/282; 250/288

(58) Field of Classification Search ..... 250/282, 250/287

See application file for complete search history.

(56) References Cited

U.S. PATENT DOCUMENTS 4,638,160 A * 1/1987 Slodzian et al. ..... 250/296
4,686,365 A * 8/1987 Meek et al. ..... 250/281
4,728,796 A * 3/1988 Brown ..... 250/423 P
5,888,846 A * 3/1999 Miyata et al. ..... 438/105

OTHER PUBLICATIONS

J. Laskin, et al. Mass Spectrometry Reviews, 2003, 22, 158-181.
Boering et al, Int. J Mass Spectrom, 1992, 222, 357-386.
S.H. Lee, et al., Mass Spectrom. Ion Processes 1987, 75, pp. 83-89.
R.A. Chorush et al., Anal Chem. 1995, 67, 1042-1046.
O. Merough et al., J. Am. Chem. Soc., 2002, 124, p. 1524-1531.
R.G.Cooks, et al., Acc. Chem. Res., 1994, 27, p. 316-323.
R.R. Dongre et al., J. Mass. Spectrom, 1996, 31, pp. 339-350.
W.R. Koppers et al., J. Chem. Phys., 1997, 107, p. 10736-10750.
C. Gu, et al.,A. Am. Chem., 1999, 121, pp. 10554-10562.
R.D. Beck, et al., Chem. Phys. Lett., 1996, 257, pp. 557-562.
J. Laskin, et al. Anal. Chem., 2002, 74, pp. 3255-3261.
G. Baykut, et al., Rapid Commun. Mass Spectro. 2000, 14, pp. 1238-1247.
P.B. O'Conner et al., Rapid Commun. Mass Spectrom. 2001, 15, pp. 1862-1868.
P.B. O'Conner et al., J. Am. Soc. Mass Spectrum. 2002, 13, pp. 402-407.
S.A. Shaffer, et al., Rapid Communi. Mass Spectrom., 1997, 11, pp. 1813-1817.
S.E. Barlow, Mark D. Tinkle, Rev. Sci Inst., 2002, 73, pp. 4185-4200.

(Continued)

*Primary Examiner*—David A. Vanore
(74) *Attorney, Agent, or Firm*—James D. Matheson

(57) ABSTRACT

The invention relates to a method and apparatus for enhanced sequencing of complex molecules using surface-induced dissociation (SID) in conjunction with mass spectrometric analysis. Results demonstrate formation of a wide distribution of structure-specific fragments having wide sequence coverage useful for sequencing and identifying the complex molecules.

15 Claims, 8 Drawing Sheets

OTHER PUBLICATIONS

M.W. Senko, et al., Rapid Commun. Mass Spectrom. 1996, 10, pp. 1839-1844.
J. Laskin et al., Journal of the American Chemical Society, 125, 2003, pp. 1625-1632.
J.Laskin et al., Journal of Chemical Physics. vol. 19, No. 6, Aug. 2003, pp. 3413-3420.
J.Qin, et al., J. Am. Chem Soc. 1995, 117, pp. 5411-5412.
S.G. Summerfield, Int. J. Mass Spectrom. Ion Processes, 162, 1997, pp. 149-161.
G. Tsaprailis, et al., Int. J. Mass Spectrom. 195/196, 2000, pp. 467-479.
Wen Yu, et al., Anal. chem. 1993, 65, pp. 3015-3023.

* cited by examiner

METHOD AND APPARATUS FOR ENHANCED SEQUENCING OF COMPLEX MOLECULES USING SURFACE-INDUCED DISSOCIATION IN CONJUNCTION WITH MASS SPECTROMETRIC ANALYSIS

This invention was made with Government support under Contract DE-AC0676RLO-1830 awarded by the U.S. Department of Energy. The Government has certain rights in the invention.

CROSS REFERENCE TO RELATED APPLICATION

This application is a Divisional of U.S. publication 2006-0043285A1, published Mar. 2, 2006.

BACKGROUND OF THE INVENTION (1) Field of the Invention

The present invention generally relates to a method and apparatus for identifying large and complex molecules. More particularly, the present invention relates to a method and apparatus for enhanced sequencing of large and complex molecules, including peptides and proteins, using fragment data generated using surface-induced dissociation in conjunction with mass spectrometric analysis.

(2) Description of Related Art

The characterization of large and complex molecules, including biomolecules such as proteins and peptides, has become a focus of applied research in recent years in efforts to advance the field of proteomics. Tandem Mass Spectrometry (MS/MS) is often employed in this effort given its ability to provide backbone structural information through fragmentation of ionized molecules in the gas phase. Fourier Transform Ion Cyclotron Resonance (FT-ICR) Mass Spectrometry (MS) is characterized by high resolution, mass accuracy, and is ideally suited for MS/MS experiments. In typical MS/MS experiments, the ion of interest is mass selected in a first MS step, activated by collision or photon excitation, and the subsequent decay into fragment ions is analyzed in a second MS step. For small ions, a single energetic collision with a neutral gas phase atom is sufficient to dissociate or fragment the ion of interest. Although structural characterization of small molecules is fairly well-established, unambiguous identification of large and complex molecules is limited and often not possible due to poor fragmentation patterns observed in even the best ion activation instruments. Poor fragmentation results in insufficient structure-specific data necessary to characterize the backbone structure of a molecule. Two fundamental limitations constrain the fragmentation of large and complex molecules in MS experiments. First, center-of-mass collision energy decreases with increasing mass of the parent ion, meaning that collision energy provided by collision becomes insufficient to cause fragmentation of a large-mass molecule. Secondly, the density of states within a molecule increases with increasing mass. Thus, with increasing size of a molecule, excitation energy is efficiently redistributed among the numerous vibrational states of the molecule thereby decreasing the fragmentation rate by many orders of magnitude at a given internal energy. It follows that efficient fragmentation of such molecules requires deposition of a large amount of energy into the internal modes of the molecule.

A variety of techniques have been introduced in the art in an attempt to increase the transfer of internal energy deposited to a molecule thereby improving fragmentation, including Multiple Collision Activation-Collision Induced Dissociation (MCA-CID), Sustained Off-Resonance Irradiation-CID (SORI-CID), Infra-Red Multi-Photon Dissociation (IR-MPD), and Surface-induced Dissociation (SID). In MCA-CID, multiple collisions between parent ions of interest and neutral gas atoms such as argon induce fragmentation whereby the ions undergo unimolecular decay yielding fragment ions containing inherent structural information representative of the parent ion. Initially, MCA-CID in FT-ICR mass spectrometry has been achieved using on-resonance excitation whereby the ions are accelerated using an on-resonance radio-frequency (RF) pulse of known amplitude and duration followed by collisional activation with a carrier gas. Unfortunately, on-resonance CID is a poor technique for characterizing large and complex molecules because ions lose kinetic energy in each collision. Thus, multiple-collision activation is inefficient.

To overcome the drawbacks of on-resonance CID for identifying large molecules in FT-ICR MS, different MCA-CID techniques have been employed in the art. For example, Boering et al. report a technique known as Very Low Energy Collision Activation (VLE-CID) in which multiple collisions are achieved using a 180-degree phase shift of the excitation waveform inducing repetitive acceleration and deceleration of ions in the ICR cell to obtain sufficient activation. Lee et al. report a Multiple-Excitation Collision Activation (MECA) technique in which precursor ions not dissociating in a first excitation step are re-excited several times until dissociation occurs. However, implementation of these techniques is rather difficult and has not found widespread application in FT-ICR mass spectrometry. Sustained Off-Resonance Irradiation-CID (SORI-CID) is a widely used MCA-CID technique in which ions under investigation are excited by a radio-frequency (RF) pulse slightly above or below the resonant frequency of the precursor ion thereby causing the ion's kinetic energy to oscillate with time. To ensure multiple collisions, the excitation pulse is applied for a time much longer than the time between collisions such that sufficient energy is accumulated in the internal modes of the ion resulting in fragmentation. Although SORI-CID is widely used for sequencing of large molecules it is well established that it preferentially explores low-energy dissociation channels meaning SORI-CID provides enough structural information only for molecules that readily fragment by many competing low-energy dissociation pathways. However, SORI-CID provides insufficient sequence information for molecules that undergo very specific fragmentation or require very high energies for dissociation. Further, successful application of MCA-CID in FT-ICR MS requires the collision gas to be removed (e.g., a collision gas pump-down delay) prior to mass analysis. If the collision gas is not removed, poor signal and mass resolution result. Low pressures in the ion cyclotron resonance (ICR) cell on the order of $1\times10^{-9}$ torr are required, necessitating a delay of from 3 to 5 seconds on average to pump out the gas prior to acquisition of MS/MS spectra. Thus, conventional CID and MCA-CID in FT-ICR MS are intrinsically slow analysis techniques.

Infra-Red Multi-Photon Dissociation (IR-MPD) is an alternative method for tandem mass spectrometry. Compared to both on-resonance and off-resonance irradiation, IR-MPD has the advantage that it does not require use of a collision gas. However, because IR-MPD is a very slow activation technique, it has similar disadvantages to SORI-CID. Namely, it follows only the lowest-energy pathways of an ion. In addition, because the fragment ions remain on the axis of the ICR cell during the laser irradiation, they may undergo subsequent fragmentation. To avoid the excessive fragmentation of sequence-informative fragments the duration of the laser pulse is decreased thereby decreasing the overall dissociation efficiency of the precursor ion.

Surface Induced Dissociation (SID) is a technique whereby fragmentation is induced by a single collision of molecules of interest with a surface. SID provides fragmentation at relatively low collision energies (<100 eV). In addition, acquisition of SID spectra in FT-ICR MS does not require introduction of a collision gas into the ICR. cell for ion activation nor the requirement to remove it prior to mass analysis, thus dramatically shortening the acquisition times. Yet, despite the many advancements made by SID, problems are well known in the art. For example, Chorush et al. reported that SID could be used for analyzing large peptides and proteins in FT-ICR MS, but their work demonstrated poorly defined collision energies, incidence angles, collection efficiencies for fragment ions, and low-quality MS/MS. spectra. Introduction of a pulsed gas was further required to confine the fragment ions to the center of the ICR cell prior to detection, making the acquisition time comparable to, or even longer than conventional SORI-CID.

The quantity of ions scattered off an SID surface has been reported to be improved using coated surfaces. Cooks et al. reported use of thin films of self-assembled monolayers (SAMs) of thiols on gold and particularly fluorinated SAMs (e.g., FSAMs). Dongre et al. reported use of thin films of hydrocarbon SAMs (e.g., HSAMs) comprising thiols on gold or silver. Other choices for thin films commonly used in the field include poly-ethers, reported by Koppers et al., Langmuir-Blodgett films on aluminum as reported by Gu et al., and pyrolytic graphite films as reported by Beck et al. Despite the advances made with use of coated surfaces, durability limitations, e.g., temperature durability, are well known in the art and continue to be a concern. Thus, there remains a need for an improved surface for performing SID, particularly for large and/or complex molecules of interest.

An important variable in MS/MS experiments is the time that molecules spend in their activated or excited state prior to detection. Some molecules may have enough energy to fragment but not enough time for dissociation to occur in a particular instrument. Conventionally SID was implemented on double-quadrupole or time-of-flight (TOF) instruments, where the observation time is on the order of 10-100 μs. Typical SID spectra for peptide ions obtained on such instruments contain the primary ion with numerous low-mass fragments. The predominant production of low-mass fragments rarely used for identification of large molecules has resulted in SID spectra for large or complex molecules being largely discounted.

Peptides are biopolymers composed of amino acid residues bonded together via peptide bonds. Peptides and polypeptides are generally asymmetric systems having a beginning $NH_2$ group or N-terminus, and an ending COOH group or C-terminus. Because proteins and peptides are composed of amino acid residues having various side chain "R" groups, in most cases, ions containing such groups are easily and uniquely identified by their measured mass-to-charge (m/z) ratio. Although accurate mass measurement is an important prerequisite for mass spectrometric analyses of large and complex molecules, it is not sufficient for identification. For example, structural isomers have the same m/z in a mass spectrum but different fragmentation patterns upon activation. As a result, structure-specific fragmentation of gas-phase ions is a critical step for peptide and protein sequencing leading to unambiguous identification of the precursor ion or parent molecule. The term "sequencing" as used herein describes any structurally identifying information pertaining to the principal arrangement of monomers in a precursor ion or parent molecule, including fragments thereof. For example, sequencing information includes, but is not limited to, data pertaining to chemical identity, position, and connectivity of the monomers in a molecule of interest. As used herein, identities of residues in a fragment also constitute sequencing information useful in identifying a parent molecule or precursor ion. In contrast, losses of $H_2O$ and $NH_3$ from the precursor ion or its subsequent fragments do not contain additional structural information. Designations used herein with reference to specific amino acid residues in a peptide chain follow standard conventions, e.g., alanine (A or Ala), cysteine (C or Cys), aspartic acid (D or Asp), glutamic acid (E or Glu), phenylalanine (F or Phe), glycine (G or Gly), histidine (H or His), isoleucine (I or lle), lysine (K or Lys), leucine (L or Leu), methionine (M or Met), asparagine (N or Asn), proline (P or Pro), glutamine (Q or Gln), arginine (R or Arg), serine (S or Ser), threonine (T or Thr), valine (V or Val), tryptophan (W or Trp), and tyrosine (Y or Tyr).

The general nomenclature for designating backbone fragments resulting from dissociation of peptide ions will now be described. The term "fragment" as used herein refers to any component, material, subcomponent, unit, subunit, segment, section, piece, or portion resulting from the dissociation or fragmentation of an ion or molecule representing less than the complete and intact ion or molecule, e.g., a fragment of a peptide of interest. For example, fragments of a peptide include, but are not limited to, charged species such as $b_n$, $a_n$, and $y_n$, generated during dissociation of the peptide, where n denotes the residue position in the intact peptide.

Location of charge along the peptide chain following dissociation designates a fragment as either a b-fragment or y-fragment. For example, b-fragments are formed by cleavage of any peptide bond (i.e., C—N bond between adjacent amino acids) with charge remaining on the N-terminus. By convention, residues in a b-fragment are counted or designated from the left-most residue to the right-most residue. Fragmentation of b-ions results in formation of a-ions. While many potential mechanisms exist for forming a-ions directly from a parent or precursor ion, it is generally accepted that b-ions lose a carbonyl or C=O moiety (28 mass units) to form a-ions, where $a_n=b_n-28$. Y-fragments are formed by cleavage of any C—N bond between two amino acid residues with charge remaining on the C-terminus. By convention, residues in a y-fragment are counted or designated from the right-most residue to the left-most residue. Other common fragments include ions with masses corresponding to multiple losses of water or losses of $NH_3$, e.g., $b_n$—$H_2O$. Internal fragments formed by cleavage of two backbone bonds are also typical in SID and include both b-type and a-type (b minus 28) fragments. Internal a-type ions composed of only one amino acid are called "immonium" ions.

In general, conventional activation methodologies provide some fragmentation data for large and complex molecules, although in many cases poor fragmentation patterns are obtained using conventional approaches meaning very little new structural information is provided whereby the sequencing may be ascertained and the molecule unambiguously identified. Given the complexity, and ultimate inability to provide sufficient structure-specific fragments to characterize moieties, it is estimated that in excess of 25% of large bio-molecules, including proteins and peptides, remain unidentified in standard MS or tandem MS/MS experiments.

As the current state of the art shows, unambiguous identification of large and complex molecules is complicated by poor dissociation patterns observed in current mass spectrometry instruments. Accordingly, there remains a need to improve structure-specific fragmentation thereby enhancing sequence coverage for identification of large and complex molecules.

SUMMARY OF THE INVENTION

The present invention generally relates to a method and apparatus for identifying large and complex molecules. More particularly, the present invention relates to a method and apparatus for enhanced sequencing of large and complex molecules using fragment data generated using surface-induced dissociation in conjunction with mass spectrometric analysis. Large and complex molecules include, but are not limited to, polymers, bio-polymers, biomaterials, biomolecules, proteins, peptides, polypeptides, carbohydrates, saccharides, polysaccharides, nucleic acids, oligonucleotides, deoxyribose nucleic acids (DNAs), ribose nucleic acids (RNAs), peptide nucleic acids (PNAs), and combinations thereof. The term "polymer" as used herein denotes any material, compound, moiety, or ion comprising conjoined monomers (mers) or subunits. Polymers include, but are not limited to, bio-polymers, bio-molecules, proteins, peptides, polypeptides, carbohydrates, saccharides, polysaccharides, nucleic acids, oligonucleotides, DNAs, RNAs, PNAs, and combinations thereof. The term "residue" is a general reference to the structural units comprising a molecule, including ions or fragments thereof. Residues include, but are not limited to, individual monomers comprising a polymer or biopolymer, individual amino acids comprising a protein, polypeptide, peptide, or fragment sequence, individual saccharides comprising a polysaccharide, and individual nucleic acids comprising an oligonucleotide, DNA, RNA, or PNA sequence. The person of ordinary skill in the art will recognize that the invention is not limited to any one class of compounds. Thus, although different nomenclatures exist for the various classes of large and complex molecules, the invention can be adapted appropriately to the different classes of compounds, including residues thereof.

In one embodiment of the invention, a target for dissociating ions is disclosed that comprises a substrate and a diamond film operably disposed on the substrate to enhance surface-induced dissociation of an ion selected from an ion beam whereby a plurality of structure-specific fragments are generated for sequencing the ion useful for identifying large and complex molecules.

In another embodiment of the invention, a spectrometer instrument is described that comprises an ion beam, means for generating and focusing the beam, and a target operably oriented to receive the beam, the target comprising a diamond film that when impacted by the beam enhances dissociation of ions in the beam useful for sequencing and identifying the ions that correspond to large and complex molecules.

In one embodiment according to the process of the invention, sequencing and identification of large and complex molecules comprises impacting a focused ion beam comprising ions from an ionized molecule of interest on a diamond film target in a mass spectrometer whereby sequencing of the backbone structure of the selected ion and identification of the molecule is made in conjunction with mass spectrometric analysis. The term "backbone structure" as used herein refers to the sequence of residues in an ion or molecule of interest, including fragments thereof, and/or information or data related thereto, e.g., fragments or fragment residues formed during surface induced dissociation of an ion or molecule that contain structure-specific information useful for sequencing and identifying the ion or molecule. The term "rigid" as used herein is a measure of the ability of a surface to dissipate initial kinetic energy of a selected precursor ion in a spectrometer. The more stiff or rigid a surface, the lower the quantity of energy absorbed by the surface and thus the greater energy available to induce fragmentation. Impacting ions of interest on the new rigid diamond target provides a wide distribution of internal energies resulting in a wide distribution of structure-specific fragments useful for sequencing and identification of large and/or complex molecules, e.g., peptide sequencing and identification. The term "wide distribution of internal energies" refers to the internal energy distribution of excited ions that is wider than the thermal distribution corresponding to the same average internal energy. Deposition of a wide internal energy distribution provides an efficient means of mixing of low- and high-energy dissociation channels available to the excited ion thereby improving the sequence coverage and thus the ability to identify a precursor ion or molecule of interest. The term "wide distribution of structure-specific fragments" refers to bond cleavages forming structure-specific fragments covering a significant portion of the possible backbone fragments necessary to sequence and identify the precursor ion or molecule of interest. The term "sequence coverage" refers to the distribution of fragments encompassing the entire mass range of a precursor ion or molecule of interest having sufficient structure-specific detail whereby a precursor ion or a molecule of interest, including fragments thereof, may be structurally sequenced and identified. Diamond SID results have demonstrated significantly improved sequence coverage for peptides tested in conjunction with the invention.

In yet another embodiment according to the process of the invention, sequencing and identification of large and complex molecules comprises providing an ion beam comprising at least one ion of a complex molecule; providing a target for dissociating ions (i.e., surface induced dissociation of ions) in the ion beam, the target comprising a diamond film; and impacting the ion beam on the diamond film target in a mass spectrometer instrument thereby forming a plurality of structure-specific fragments having a sequence coverage sufficient for sequencing the at least one ion and thus for identifying the complex molecule. Preparation of the sample may involve mixing of the starting material, e.g., a peptide, with a matrix solution and delivering the mixed sample to an instrument holder or sample tray. Based on spectral peak m/z values, lists of peak candidate ions may be compiled from various database sources for comparing fragment ions generated in the MS experiment. Identification of fragments provides a map of the backbone structure of the ion whereby the parent molecule may be identified.

While the present invention is described herein with reference to various embodiments thereof, it should be understood that the invention is not limited thereto, and many alternatives in form and detail may be made therein without departing from the spirit and scope of the invention. For example, those of ordinary skill in the art will recognize that methods disclosed herein may be practiced with any of a number of mass spectrometers or tandem instruments, analyzers, and components thereof including, but not limited to, ionization sources, mass analyzers and detectors. Thus, no limitation in instrumentation and/or mass analyzer components is intended by the disclosure of the preferred embodiments. In addition, applications of the method on a commercial scale may comprise additional components, ion activation, ion-acceleration, ion sources, accumulation, release, detection, and associated approaches/methods without departing from the broader aspects of the present invention. All such components and/or modifications as would be envisioned, applied, practiced, or performed by the person of ordinary skill in the art are hereby incorporated.+

BRIEF DESCRIPTION OF THE DRAWINGS

A more complete appreciation of the invention will be readily obtained by reference to the following description of the accompanying drawings in which like numerals in different figures represent the same structures or elements.

DETAILED DESCRIPTION OF THE EMBODIMENTS

Surface Induced Dissociation (SID) on rigid diamond targets or surfaces presents an entirely new concept for sequencing complex molecules, including, but not limited to, peptides and proteins leading to unambiguous identification thereof. An FT-ICR MS and MALDI ionization system combined with the SID target of the present invention offers very high mass resolution and mass accuracy, as well as multiple stages of tandem mass spectrometry essential for many applications and analyses. Experimental results have demonstrated that SID on rigid diamond surfaces results in significantly improved sequence coverage for large and complex molecules such as peptides and proteins.

Figure 1A:
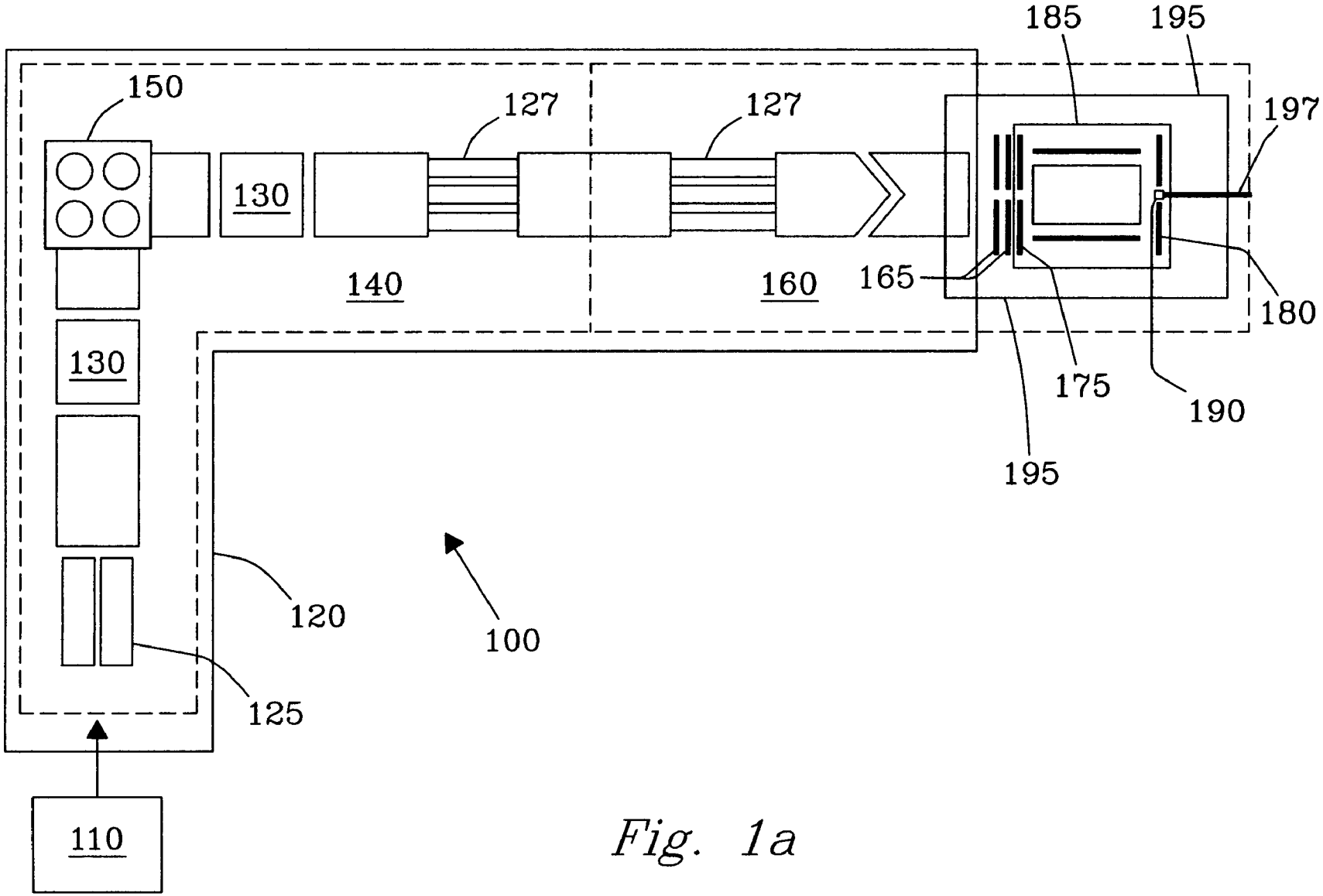
FIG. 1*a* presents a schematic view of a specially designed 6T FT-ICR mass spectrometer configured with a diamond film target according to one embodiment of the present invention.

FIG. 1*a* illustrates a specially designed Fourier Transform Ion Cyclotron Resonance (FT-ICR) Mass Spectrometer 100 constructed in-house for SID studies, as described in detail in Laskin et al. [*Anal. Chem.* 2002, 74, p. 3255], which disclosure is incorporated herein by reference in its entirety. The instrument comprises an ion source 110 for ionizing molecules of sample materials into precursor ions of interest, an electrostatic ion guide 120 comprising any of a number of segmented tube lenses 125 and 127 permitting ion steering, and non-segmented tube lenses 130 for focusing beams of ions, an electrostatic quadrupole bender 150 for decreasing the footprint of the spectrometer and for preventing molecular flow of neutral molecules into the ultra-high vacuum (UHV) chamber region 160 of the mass spectrometer. The instrument comprises two differentially pumped vacuum chambers 140 and 160. Chamber 140 encompassing one each of segmented tube lenses 125 and 127, non-segmented tube lenses 130, and quadrupole bender 150 was pumped by a 280 L/s turbomolecular pump, e.g., a Turbo-V300HT (Varian Vacuum Technologies, Lexington, Mass.) to a pressure of from about $3\times10^{-7}$ Torr to about $7\times10^{-7}$ Torr depending on the pressure in the ion source 110. Chamber 160 (or the UHV 160) encompassing a second of two segmented tube lens 127, deceleration plate lenses 165 mounted in series for decelerating the ion beam, as well as trapping plates 175 and 180 mounted in the front and to the rear of Ion Cyclotron Resonance (ICR) cell 185 was evacuated by a 550 L/s turbomolecular pump, e.g., a Turbo-V550 (Varian Vacuum Technologies, Lexington, Mass.) and by a 900 L/s cryopump, e.g., model RPK900 (Leybold, Cologne, Del.) to a pressure of from about 0.3 to about $1.5\times10^{-9}$ Torr.

A 3-mm diameter target 190 comprising a rigid diamond film for performing surface-induced dissociation (i.e., SID target 190) was mounted on an electrical feed-through welded at the end of a custom-built insertion rod 197 for positioning the target adjacent to rear trapping plate 180 of ICR cell 185. The SID target 190 was introduced into the ultrahigh vacuum (UHV) region 160 of the FT-ICR through a vacuum-lock system (VLS), detailed in Laskin et al. 2002, comprising a series of vacuum seals at the rear of the instrument. The VLS was designed such that the SID target when introduced by the rod into the UHV chamber could be done without breaking vacuum. The VLS consisted of two stages of differential pumping, maintained at $1\times10^{-3}$ Torr and $5\times10^{-8}$ Torr, respectively, using standard evacuation pumps, e.g., a 70 L/s turbomolecular pump (Leybold).

Components 165, 175, 180, and 190 were encompassed within a commercially available superconducting magnet 195 (Cryomagnetics, Oak Ridge, Tenn.). The magnet had a field strength of 6-Tesla (6 T), but is not limited thereto. For example, field strengths of at least about 1 Tesla may be successfully employed.

Figure 1B:
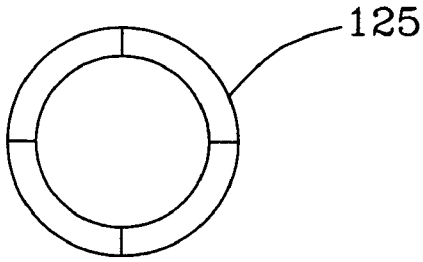
FIG. 1*b* presents an end-on view of a standard 4-segment (segmented) tube lens illustrated in FIG. 1*a*.

FIG. 1*b* presents an end-on view of segmented tube lens 125. used to align (axis-on-axis) the instrument. A four-segment lens is illustrated, but is not limited thereto. Any segmented lens may be appropriately employed, as would be known by persons of ordinary skill in the art.

Figure 1C:
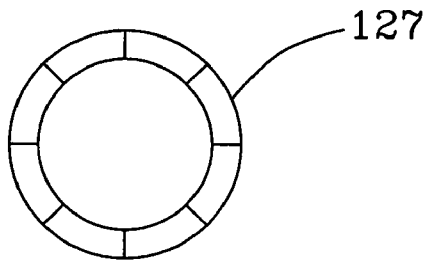
FIG. 1*c* presents an end-on view of a standard 8-segment (segmented) tube lens illustrated in FIG. 1*a*.
Figure 1D:
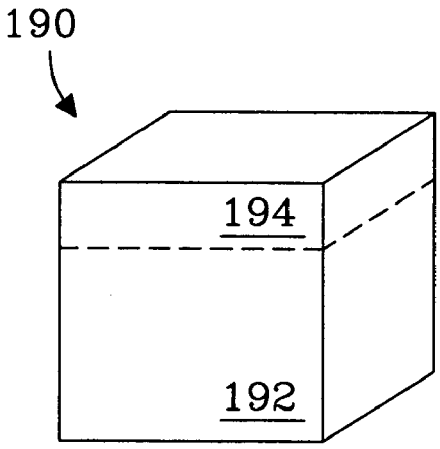
FIGS. 1*d*-1*g* illustrate a diamond target of FIG. 1*a* with and without an interface layer, according to different embodiments of the invention.
Figure 1E:
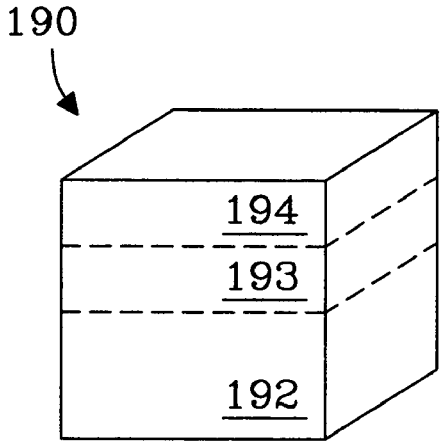
Figure 1F:
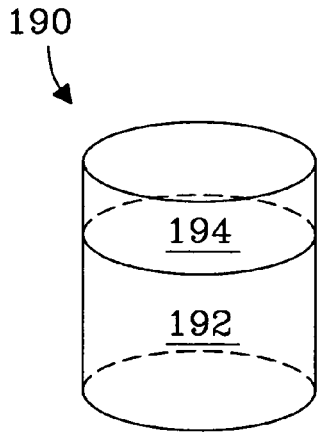
Figure 1G:
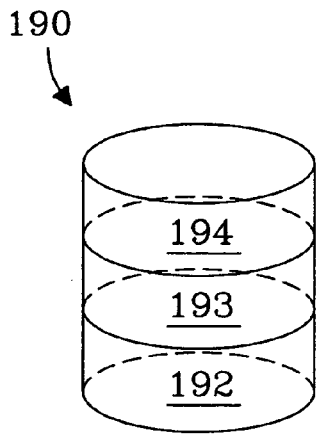

FIG. 1*c* presents an end-on view of segmented tube lenses 127. An eight-segment lens is illustrated, but is not limited thereto. Any segmented lens suited to ion steering may be appropriately employed.

FIGS. 1*d*-1*g* illustrate diamond target 190 of FIG. 1*a* with and without an interface layer, according to different embodiments of the invention. In one embodiment illustrated in FIG. 1*d*, target 190 for effecting surface induced dissociation is of a substantially rectangular shape and includes a diamond layer 194 deposited, e.g., by Carbon Vapor Deposition (CVD), onto a substrate 192 as described herein. In another embodiment illustrated in FIG. 1*e*, target 190 is of a substantially rectangular shape and may further include an interface layer 193 deposited (e.g., by CVD) on substrate 192 if necessary to adhere diamond layer 194 thereto as described further herein. In yet another embodiment illustrated in FIG. 1*f*, target 190 is of a substantially cylindrical shape and includes a diamond layer 194 deposited onto substrate 192. In still yet another embodiment illustrated in FIG. 1*g*, target 190 is of a substantially cylindrical shape and may further include an interface layer 193 deposited onto substrate 192 if necessary to adhere diamond layer 194 thereto as described further herein. Dimensions of target 190 including thicknesses of diamond layer 194 are as described herein.

Source 110 was located external to the magnetic field and ultrahigh vacuum (UHV) region 160 of the spectrometer but is not limited thereto. Use of the external source allowed for rapid and convenient sample changing, higher operating pressures, and enabled a good control over the kinetic and internal energies of ions. The ion source was preferably a "soft" source, but is not limited thereto. The term "soft" as used herein refers to a source whereby the material being ionized is introduced to and remains largely intact into the gas phase. Use of a soft source permitted introduction of both complex and/or large biomaterials into the gas phase without a significant loss of signal due to fragmentation. Ionization sources include, but are not limited to, matrix-assisted laser desorption/ionization (MALDI), electrospray ionization (ESI), sonic spray ionization, fast atom bombardment (FAB) ionization, atmospheric pressure ionization; liquid ionization from droplets (LIL-BID), field-desorption ionization, laser desorption without a matrix, or combinations thereof. For example, ESI typically produces multiply-protonated (charged) species, e.g., peptides, whereas MALDI predominantly yields singly protonated (charged) species. MALDI was a more preferred ionization source given its robustness against sample contamination and its ability to provide relatively simple mass spectra from complex sample mixtures composed largely of singly charged ions.

The MALDI ion source will be described in further detail with reference to FIG. 2.

Figure 2:
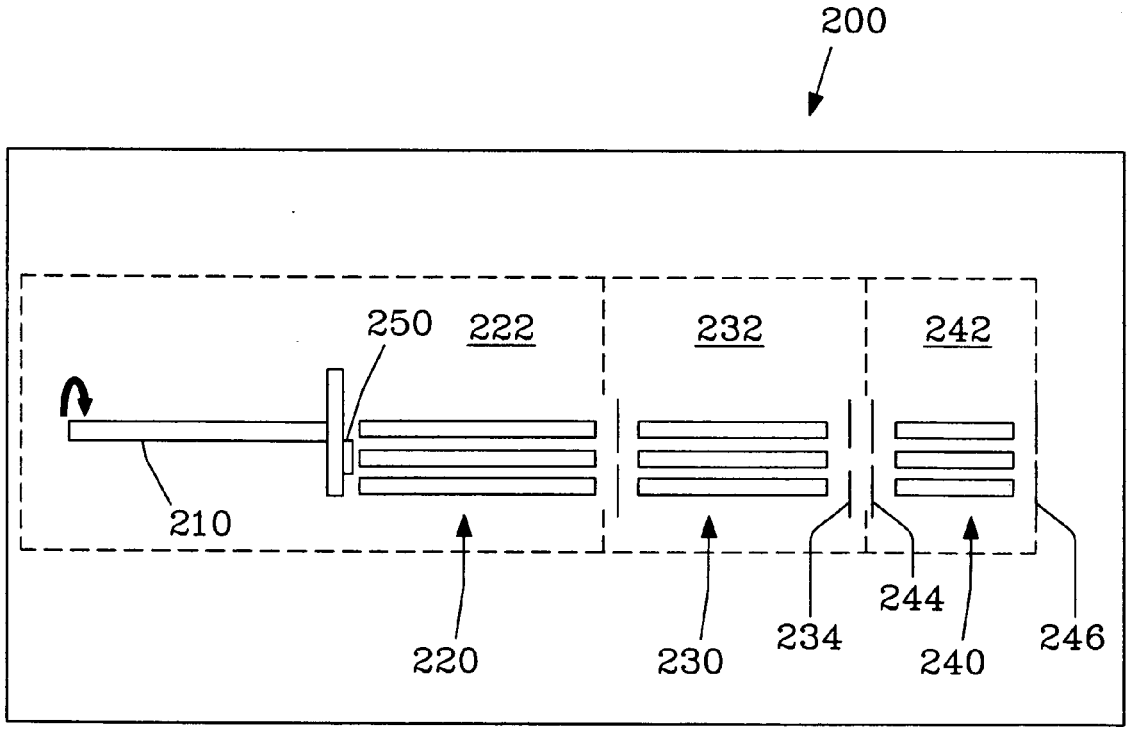
FIG. 2 presents a schematic view of an intermediate-pressure MALDI ionization source showing three differentially-pumped pressure regions of operation according to one embodiment of the invention.

FIG. 2 presents a schematic view of an in-house built, intermediate-pressure MALDI source 200 used in conjunction with the present invention, based on a design by Baykut et al. [*Rapid Commun. Mass Spectrom.* 2000, 14, p. 1238] and O'Connor et al. [*Rapid Commun. Mass Spectrom.* 2001, 15, p. 1862 and *J. Am. Soc. Mass Spectrum.* 2002, 13, p. 402], incorporated herein by reference in their entirety. The MALDI source comprised a standard sample plate (not shown) with 10 slots having sample spots (not shown) of characteristic size in the range from about 0.2 mm to about 0.4 mm. The sample plate was held in place by a small magnet (not shown) on a standard Bruker sample holder 210 (Bruker Daltonik GmbH, 28359 Bremen, GE). Sample holder 210 was modified to be electrically insulated from the sample plate thereby allowing a desired potential to be applied to the sample plate. The MALDI source further comprised a collisional quadrupole (CQ) 220 providing for collisional cooling and focusing of the ion beam and limiting fragmentation of the ions of interest, a resolving quadrupole (RQ) 230 for mass-selection of ions of interest, and an accumulation quadrupole (AQ) 240 for accumulating ions prior to fragmentation, described in more detail hereafter.

Three differentially-pumped pressure regions (vacuum chambers) of operation are illustrated in FIG. 2 in conjunction with quadrupoles 220, 230, and 240. A first pressure region ($P_{Q1}$) 222, encompassing the CQ 220, sample holder 210, sample plate, and spots, was operated at a pressure $P_{Q1}$ of at least about $20\times10^{-3}$ Torr. Components of pressure region 222 (e.g., the sample holder, sample plate, sample spots and CQ) were positioned inside a six-inch cube vacuum chamber and evacuated at 14 L/s using a model E2M40 mechanical pump (BOC Edwards, Crawley, U.K.). The CQ comprises a 280-mm long rod (diameter=9.525 mm) operated in the radio frequency (RF)-only mode at a static pressure in the range from about $1\times10^{-2}$ Torr (10 mTorr) to about $5\times10^{-2}$ Torr (50 mTorr) maintained by leaking air into chamber 222 through a standard leak valve. A second pressure region ($P_{Q2}$) 232 encompassing the RQ 230 was operated at a pressure $P_{Q2}$ of at least about $5\times10^{-5}$ Torr. A third pressure region ($P_{Q3}$) 242 encompassing the AQ 240 was operated at a pressure $P_{Q3}$ of at least about $2\times10^{-3}$ Torr. Mass-resolving quadrupole (RQ) 230 and accumulation quadrupole (AQ) 240 located in differentially-pumped pressure regions (vacuum chambers) 232 and 242, respectively, were separated from the CQ by a 1-mm hole. The vacuum chambers housing the AQ and RQ were evacuated at 350 L/s using a model TMP/NT-360 turbomolecular pump (Leybold, Cologne, GE).

The sample plate in sample holder 210 was placed about 1-mm away from CQ 220, the axis of the holder being displaced from the axis of the CQ such that sample spots were located exactly on the axis of CQ. Switching between the different sample spots was achieved by rotating the sample holder. Light from MALDI source laser 250, a 337.1 nm nitrogen laser (Laser Science, Inc., Franklin, Mass.), was transferred via a 2-meter fiber cable (Thermo Oriel, Stratford, Conn.) (not shown) and refocused on the sample spots (0.2-0.4 mm in diameter) using two 75-mm planoconvex lenses (e.g., lenses from Knight Optical, Whitehall Road, Rochester, U.K.). The laser beam was introduced into vacuum chamber 222 housing the CQ and sample holder through a glass view window. The laser beam was positioned to pass through the CQ rods and hit the sample spot at an incidence angle of about 45 degrees. The laser intensity was measured using a model J8LP-030 joulemeter (Molectron Detector, Portland, Oreg.) exhibiting a pulse intensity of 250 μJ and 150 μJ at the output of the laser 250 and fiber cable, respectively. Optimal ion signal was obtained using a tightly focused 30 μJ pulse laser spot on the sample spots.

Precursor ions were generated in an external ion source 110, e.g., a high-transmission MALDI source 200 (described in more detail herein below), and extracted into an electrostatic ion guide 120, and transferred to the ICR cell 185.

Ions were mass-selected in the RQ, a 200-mm long, 9.525 mm diameter rod (Extrel, Pittsburgh, Pa.). The RQ had mass range selection capability up to about 4000 amu, and was controlled using a model 150-QC power supply (Extrel, Pittsburgh, Pa.) operating at 300-W and 880 kHz. A collimating plate 234 was positioned following the RQ.

Ions were accumulated using a custom-built 45-mm long, 9.525-mm diameter rod AQ. The AQ 240 was used for both ion accumulation and collisional relaxation of mass-selected ions. The AQ was enclosed in a vacuum-sealed container pumped through two 1-mm apertures in trapping plates 244 and 246. Pressure of the AQ was maintained by leaking collision gas through a 300-mm long tube (I.D.=2 mm) (not shown) with a backing pressure monitored by a standard thermocouple gauge. Pressure in the AQ was configured to be variable in the range from about $1\times10^{-4}$ Torr to about $2\times10^{-3}$ Torr without affecting pressure in other portions of the vacuum system. The RQ and AQ were driven by an in-house built sinusoidal wave generating resonator (a "high-Q" head) (not shown) operating at a frequency of ~850 kHz and having a peak-to-peak operating voltage of 600-700 V. Ions resulting from one or more laser pulses were accumulated in the AQ 240 and extracted into the ICR cell 185. The AQ was designed to be sufficiently short such that ions extracted from the AQ had a very well-defined and fairly narrow distribution of kinetic energies (<2 eV) full-width at half maximum (fwhm), important for efficient trapping of ions in the ICR cell. [Laskin, 2002]. Voltages typical of the MALDI source were as follows: sample plate voltage, 30-40 V; CQ offset, 25V; conductance limit, 10-12 V; RQ offset, 7 V; and AQ offset, 4-6 V. In addition, front and rear trapping plates, 244 and 246, in the AQ were kept at +14 V and +17 V, respectively, during ion accumulation and relaxation, and at +30 V and −10 V, respectively, during ion extraction from the AQ.

Ions were impacted on SID target 190 at an incidence angle of zero degrees with respect to the surface normal vector—the normal incidence collision. However, ions may be impacted in the range from about zero degrees to about 90 degrees relative to the target surface normal vector. Thus, no limitation is intended by the angle of incidence disclosed in the instant case.

The ICR cell 185 was used for collection and mass analysis of resulting fragments. Ions were transferred into the ICR cell using electrostatic ion guide 120 and trapped using gated trapping, as reported in Laskin et al. [2002] and incorporated in its entirety herein. The cylindrical ICR cell 185 was specially fabricated and designed to eliminate the fourth-order term in the electrostatic trapping field, as detailed in Tinkle et al. [*Rev. Sci. Inst.*, 2002, 73, pp. 4185-4205] and incorporated herein by reference in its entirety. Trapping conditions were optimized by floating the entire ICR cell off the ground potential and adjusting the time-of-flight delay.

Tandem MS (MS/MS) was performed by colliding the externally produced ions on the surface of the diamond coated target 190 introduced to, and positioned about 1 mm inside of, the rear trapping plate 180 of the ICR cell 185. The target surface was electrically connected to the rear trapping plate power supply, ensuring that the surface and the rear trapping plate were at the same potential throughout the analyses. The kinetic energy of the ions striking the target surface was varied by changing the dc offset applied to the ICR cell and both trapping plates 175 and 180 thereby eliminating defocusing of the ion beam by the ion transfer optics as a function of ion kinetic energy. The collision energy was defined by the difference in potential applied to the AQ 240 and the potential applied to the rear trapping plate and the SID target. The ICR cell 185 could be offset above or below ground by as much as ±150 V. Lowering the ICR cell potential below ground while keeping the potential of the AQ fixed increased the collision energy for positive ions. Because the final adjustment of the translational energy of ions was performed within the constant high magnetic field region of the ICR, ion transmission characteristics of the instrument remained the same at all collision energies. As a result, the parent ion currents and ion trajectories were constant and independent of the collision energy. To avoid charging of the surface by impacting ions, the target was prepared using a substrate comprising an electrically conducting material. Conducting materials suitable for targets include, but are not limited to metals, and conductive alloys. Examples of suitable metals include, but are not limited to, titanium (Ti), iron (Fe), copper (Cu), and molybdenum (Mo). Conductive alloys include, but are not limited to, stainless steels, ferrous alloys, copper alloys, titanium alloys, and combinations thereof.

To decrease neutralization of ions on the surface, the target 190 was coated with a diamond film using standard carbon vapor deposition (CVD) techniques. The diamond film coating the target is preferably of a thickness greater than or equal to about 50 nm. More preferably, diamond film thickness is in the range from about 50 nm to about 50 μm. Most preferably, diamond film thickness is up to about 2 μm. Materials known to accept diamond coatings with moderate to good adhesion include semiconductor materials, silicon, silicon carbide, composite materials, treated graphites, metals including titanium and molybdenum, alloys, and combinations thereof. Other materials including oxide ceramics, copper, iron (including ferrous alloys) will usually not accept thick adherent diamond coatings without interface layers of compatible materials, e.g., an interface layer disposed between the substrate and the diamond film.

The person of ordinary skill in the art will recognize that various mass-spectrometer (MS) instruments, MS components, tandem MS experiments, and combinations thereof may be used without deviating from the true spirit of the present invention. For example, various MS instruments may be utilized, including, but not limited to, Fourier Transform instruments, e.g., Fourier Transform Ion Coupled Resonance (FT-ICR) instruments, tandem instruments, time-of-flight (TOF) instruments, ion-trap instruments, e.g., RF- and Paul-ion-trap instruments, quadrupole instruments, sector instruments, e.g., magnetic sector instruments, and combinations thereof. Additionally, various and varied instrumental or MS components may be employed, including magnets having field strengths greater than or equal to about 1 Tesla. In addition, the rigid diamond target as described herein may be utilized in other MS instruments or with other MS components.

A modular ICR data acquisition system (MIDAS) was used to control the voltages and timing of the MALDI source, firing of the laser, ion trapping in the AQ and the ICR cell, and transfer optics as well as the excitation/detection events and voltages in the ICR cell, as detailed in Senko et al. [*Rapid Commun. Mass Spectrom.* 1996, 10, p. 1839] and incorporated in its entirety herein by reference. Compiled versions of the MIDAS data station software incorporating the latest updates in MicrosoftWindows™-based software were acquired from the National High-Field Magnetic Laboratory (Tallahassee, Fla.). Output voltages from the MIDAS were amplified using noninverting power amplifiers (PA85, Apex Microtechnolgy, Tucson, Ariz.) up to ±140 V. Excitation waveforms produced by the MIDAS waveform generator-were amplified using a broadband (10 kHz-250 MHz) 97-Watt power amplifier, e.g., a model 75A250 amplifier (Amplifier Research, Souderton, Pa.). Image current was detected using a preamplifier with an amplification factor of 1400.

Scripts provided in the MIDAS software allowed for both manual was well as unattended, automated acquisition of kinetic data. MIDAS allowed for varying of fragmentation delays and collision energies during acquisition of SID spectra across the entire range of collision energies in 1 eV increments at various and/or multiple fragmentation delays, e.g., six fragmentation delays from 1 ms, 10 ms, 50 ms, 0.1 sec, 0.3 sec, and 1 sec. For each fragmentation delay; time-dependent fragmentation efficiency curves (TFECs) were optionally constructed using experimentally derived mass-spectral data. TFEC's were used to show the dependence of the relative abundance of an ion in the spectrum as a function of collision energy whereby optimum collision energies and fragmentation delays were selected thereby offering a way to obtain information on the relative stability of the gas-phase precursor ions derived from the parent material. TFECs, if used, were constructed by plotting relative intensity of the parent precursor ions as a function of collision energy (eV), as detailed in Laskin et al., [*Mass Spectrometry Reviews*, 2003, 22, pp. 158-181] and incorporated in its entirety by reference herein.

Figure 3:
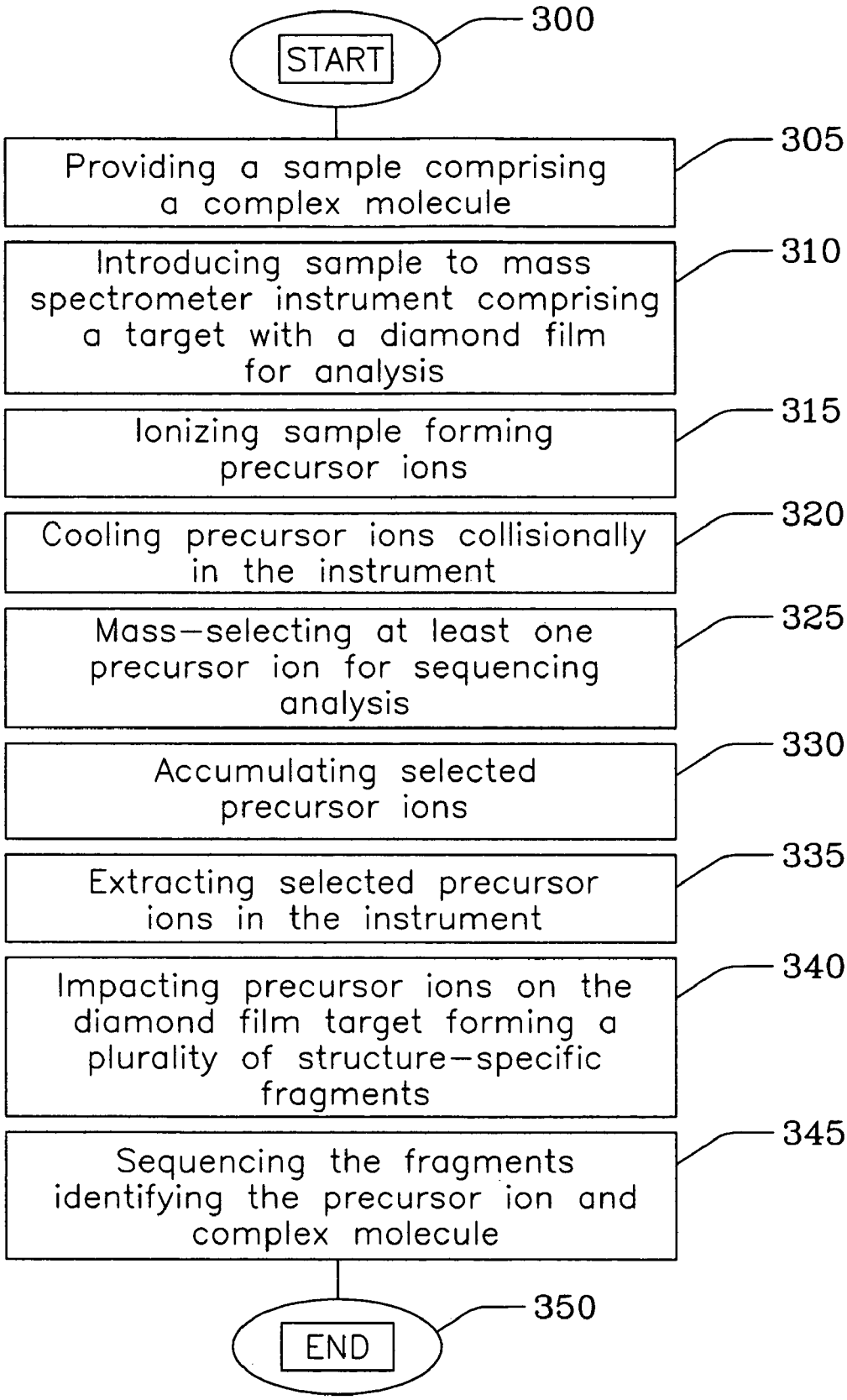
FIG. 3 presents the steps for sequencing and identifying large and complex molecules according to one embodiment of the process of the invention.

FIG. 3 illustrates one embodiment according to the process of the invention for a MS or tandem MS analysis of a complex material, e.g., FT-ICR MS analysis, comprising the steps: START 300; providing a sample comprising a complex molecule 305. The sample may be prepared by introducing the complex molecule into a matrix, as is known in the art, e.g., a liquid matrix comprising 2,5-dihydroxybenzoic acid (DHB) or DHB in methanol. Alternatively, components of a complex material may be individually separated using various techniques known in the art including, but not limited to, liquid chromatography, and gel electrophoresis prior to preparation of the sample as described hereinabove and/or analysis in a mass spectrometer; introducing the sample to a mass spectrometer instrument configured with a target for conducting surface induced dissociation comprising a diamond film for analysis 310, e.g., delivering an aliquot of the sample material to an instrument sample plate forming a uniform sample spot in preparation for analysis; ionizing the sample thereby forming the precursor ion of the molecule 315, e.g., irradiating a sample spot containing a complex material with a laser thereby ionizing the material in the sample spot forming a plume of precursor ions; "cooling" the precursor ions collisionally in the instrument 320, e.g., in a collisional quadrupole of a mass spectrometer; mass-selecting at least one of the precursor ions in the instrument for sequencing analysis 325, e.g., mass filtering in a first stage MS at a known m/z ratio; accumulating the at least one precursor ions in the instrument 330, e.g., in an accumulation quadrupole of the mass spectrometer; extracting the at least one precursor ions in the instrument 335, e.g., into an ion guide comprising a Fourier Transform ion-cyclotron resonance (FT-ICR) cell wherein resides the diamond coated target; impacting the at least one precursor ions in the focused ion beam on the target oriented to receive the beam thereby forming a plurality of structure-specific fragments for sequencing the at least one ion 340, e.g., impacting precursor ions on a diamond target (i.e., in diamond SID) producing fragments having a sequence coverage sufficiently wide for sequencing the ion; sequencing the fragments thereby identifying the at least one ion and the complex molecule 345, e.g., identifying peak candidates corresponding to m/z values for structure-specific fragments and sequencing the fragments thereby mapping the backbone structure of the precursor and the complex molecule; END 350. Sequencing typically involves reconstructing the original backbone structure of the precursor ion [e.g., $MH]^+$ using fragment data and patterns compiled from the experimentally-derived SID mass spectra. Alternatively, resulting fragments may be analyzed in a second MS stage (e.g., tandem MS/MS). The person of ordinary skill in the art will recognize that any of a number "n" or tandem MS stages (e.g., MS″) and/or analysis techniques may be effectively combined or coupled for analysis. Thus, no limitation is hereby implied by the description of the present embodiment.

Kinetics and dynamics data were compiled from diamond SID target results involving various standard tryptic-like peptides as test samples having a C-terminal arginine or lysine moiety, the most basic amino acids that can sequester a proton. Tryptic peptides comprising up to about 16 conjoined amino acid residues were tested to show the validity of the present invention for sequencing of peptides, including, e.g., an 8-residue des-$Arg^1$-bradykinin peptide ("des" referring to a missing arginine (Arg) residue in the first residue position) having the sequence set forth in SEQ. ID. NO: 1, but are not limited thereto. For example, other peptides may be utilized, e.g., peptides derived from de novo sequencing. In addition, other polymers and biomaterials may be analyzed using the process of the present invention. Thus, no limitation in materials identified using the present invention is intended by the disclosure of the represented test compounds. Other complex and/or large molecules as would be envisioned by a person of ordinary skill in the art are hereby incorporated.

Sample Preparation. Peptides tested in conjunction with the present invention were commercially available (Sigma-Aldrich, St. Louis, Mo.) and used without further purification. Samples were prepared in a liquid matrix comprising 2,5-dihydroxybenzoic acid, DHB (Sigma-Aldrich, St. Louis, Mo.). Approximately 10-20 μM solution (containing 0.1% trifluoroacetic acid in water) of each sample peptide was premixed with the same volume of 20 mg/mL DHB in methanol. 0.5-1 μL of the resulting solution was deposited onto the FT-ICR sample plate and allowed to dry, i.e., by the standard "dry-droplet" approach. Other peptide samples were prepared similarly.

Experimental. In one example of the process of the invention, the FT-ICR mass spectrometer was configured for use with the diamond SID target of the present invention. Precursor ions externally produced in the MALDI source were impacted on the rigid diamond target in the ICR cell, while the ICR cell was used for collection and mass analysis of the resulting fragments. This experimental approach provided several distinct advantages for peptide identification Including long reaction times thereby enabling the observation of primary fragments even for the largest of precursor ions. . In addition, the high mass-resolving power of the FT-ICR MS instrument combined with multiple MS/MS stages was important for unambiguous identification of fragments.

SID spectra were obtained by collecting mass-selected ions of interest from five laser shots in the AQ prior to extraction into the ICR cell. Each spectrum represented an average of 10 acquisitions corresponding to an average of 50 laser shots. SID collision energies were chosen for each peptide such that minimal fragmentation was observed at the lowest energies and extensive fragmentation was observed at the highest collision energies. Fragment spectra will now be described in more detail with reference to FIGS. 4-5.

Figure 4:
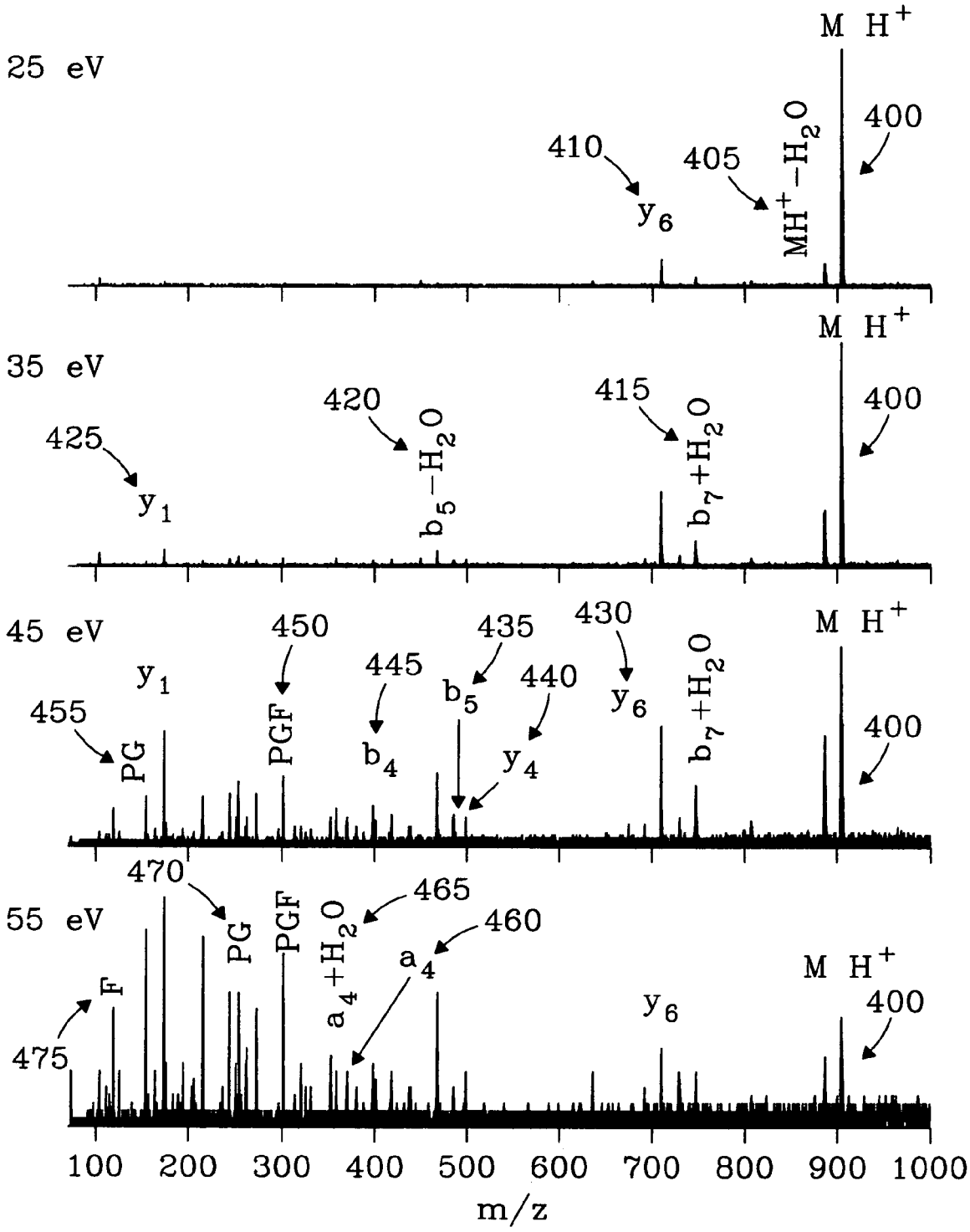
FIG. 4 shows an SID fragmentation spectrum generated in accordance with the present invention for des-ARG$^1$-bradykinin, a peptide having the sequence set forth in SEQ. ID. NO: 1, as a function of collision energy.

FIG. 4 presents SID fragmentation spectra for a singly protonated peptide, des-$Arg^1$-bradykinin, having the sequence set forth in SEQ. ID. NO: 1 as a function of excitation voltage, according to a first example of the present invention. At low collision energies, spectra evidenced structurally significant fragmentation profiles, including presence of the selected precursor ion $[MH]^+$ 400 at all collision energies. The term "low collision energy" as used herein refers to impact energies whereby precursor ions gain kinetic energies in the range from about 0 eV to about 30 eV without producing extensive fragmentation. For example, at 25 eV, the des-$Arg^1$-bradykinin peptide showed a characteristic fragment 405 corresponding to loss of water from the precursor (e.g., $MH^+$—$H_2O$) and a single structure-specific $y_6$ fragment 410 formed by cleavage of one backbone bond with the charge remaining at the C-terminus. At 35 eV, dissociation of des-Arg1-bradykinin on the diamond target produced new structurally significant fragments representing new fragmentation channels, a $b_7+H_2O$ fragment 415 characteristic of cleavage C-terminal to a phenylalanine (F) residue, a $b_5$—$H_2O$ fragment 420 characteristic of a cleavage C-terminal to a serine (S) residue, and a small abundance of $y_1$ fragment 425 characteristic of cleavage C-terminal to an arginine (R) residue, in addition to the parent $MH^+$ and the $MH^+$—$H_2O$ fragments observed in the 25 eV spectrum.

At high collision energies, spectra showed extensive fragmentation profiles with significant structural detail including again the presence of the selected parent precursor ion $[MH]^+$ 400. The term "high collision energy" as used herein refers to collisions whereby precursor ions are accelerated at kinetic energies in the range from about 45 eV to about 150 eV. At a collision energy of 45 eV, for example, a large increase in the number of structurally identifying and sequence-specific backbone fragments were generated representing new fragmentation channels, including $y_6$ 430, $b_5$ 435, $y_4$ 440, $b_4$ 445, and internal fragments PGF 450 and PG 455 containing amino acids 2-4 and 2-3, respectively, of SEQ. ID. NO: 1, including presence of parent precursor ions $[MH]^+$. At a collision energy of 55 eV, still further increases in new structure-specific fragments were observed including $a_4$ 460, $a_4$—$H_2O$ 465, and new inter-molecular fragments PF 470, and F 475 containing amino acids 6-7 and 7, respectively, of SEQ. ID. NO: 1. Again, precursor ions 400 were still evident in the spectrum.

As demonstrated in FIG. 4, SID fragmentation on the diamond target yielded major structural fragments $y_6$ 410 $y_4$ 440 and $y_1$ 425 corresponding to cleavage C-terminal to glycine (G-residue), serine (S-residue), and phenylalanine (F-residue), respectively. Further, new b-ion fragments $b_4$ 445 and $b_5$ 435 and a very informative series of structurally and sequence-specific internal fragments PGF 450, PG 455, PF 470, and F 475 comprising proline (P), glycine (G), and phenylalanine (F) residues were formed by cleavage of two internal bonds at the higher fragmentation energies. Diamond target results from SID showed a wide distribution of structure-specific fragments and energies correlating with a wide sequence coverage, strong evidence of the mixing of both high- and low-energy dissociation channels. In addition, retention of the precursor ion 400 at all selected energies provided accurate mass information for the precursor ion.

Figure 5:
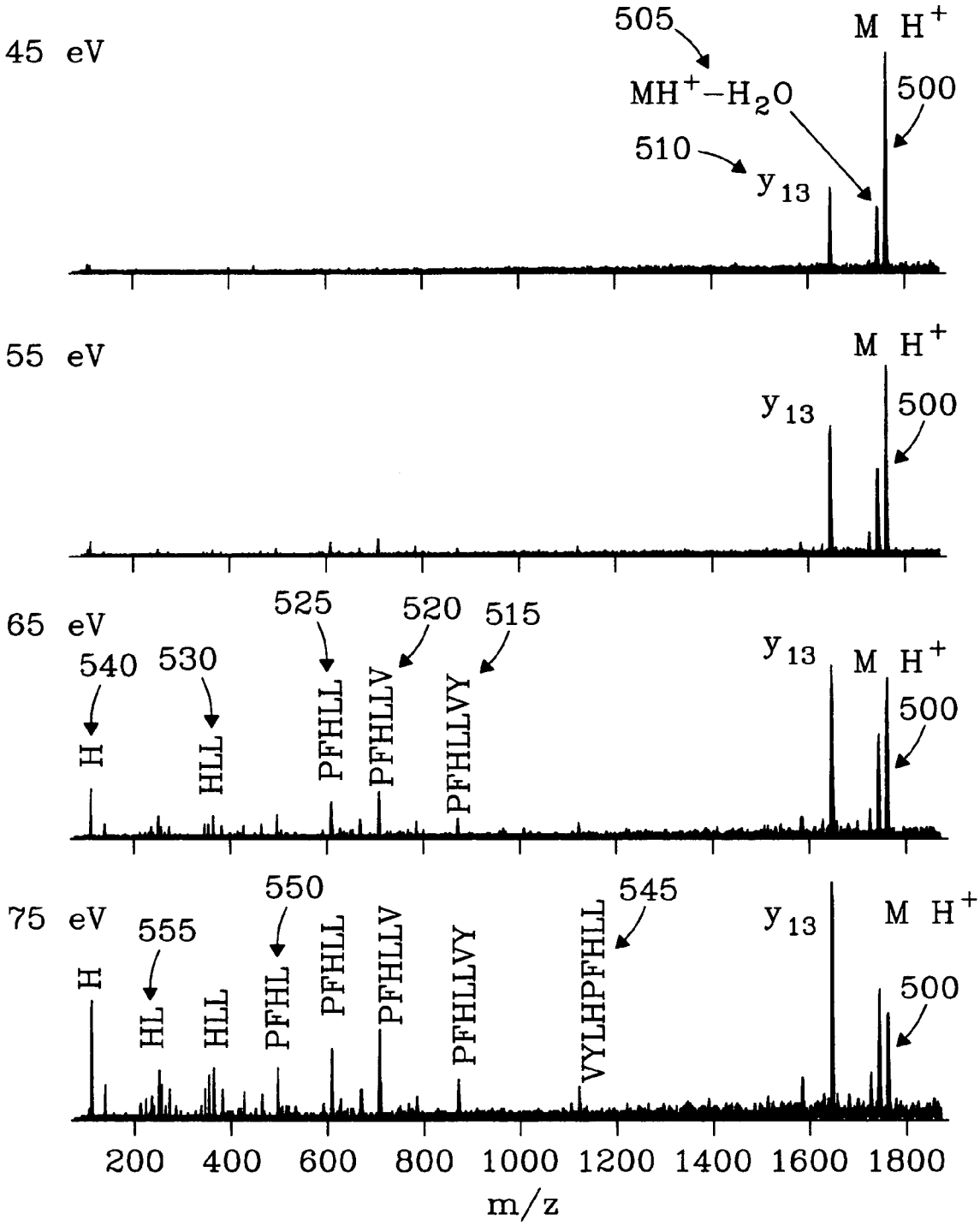
FIG. 5 shows an SID fragmentation spectrum generated in accordance with the present invention for renin substrate tetradecapeptide porcine, a peptide having the sequence set forth in SEQ. ID. NO: 2, as a function of collision energy.

FIG. 5 shows SID fragmentation spectra for a singly protonated 14-residue peptide, renin substrate tetradecapeptide porcine, having the sequence set forth in SEQ. ID. NO: 2 as a function of collision energy, according to a second example of the present invention. High-energy spectra at or above 65 eV again showed extensive fragmentation profiles with significant structural detail including presence of the parent precursor ion ($[MH]^+$) 500. With the larger precursor ion, 45 eV represented the lowest collision energy necessary for fragmentation. At 45 eV, renin substrate tetradecapeptide porcine underwent fragmentation analogous to des-$ARG^1$-bradykinin (SEQ. ID. NO: 1) yielding a first fragment 505 corresponding to loss of water (e.g., $[MH]^+$—$H_2O$) and a backbone $y_{13}$ fragment 510 charged at the C-terminus, characteristic of cleavage C-terminal to the aspartic acid (D) residue. At about 65 eV, dramatic and marked differences in the fragmentation profiles were observed. Fragmentation produced a host of structurally significant and sequence-specific fragments, e.g., PFHLLVY 515, PFHLLV 520, PFHLL 525, HLL 530, and H 540, (comprising amino acids 7-13, 7-12, 7-11, 9-11, and 9, respectively, of SEQ. ID. NO: 2) in addition to the parent precursor $MH^+$ 500 and the $MH^+$—$H_2O$ 505 fragments seen previously in spectra at 45 eV and 55 eV. At 75 eV, still additional new and structurally identifying and sequence-specific backbone fragments were produced, including VYIHPFHLL 545, PFHL 550 and HL 555, (comprising amino acids 3-11, 7-10, and 9-10, respectively, of SEQ. ID. NO: 2) with an abundance of parent precursor ions still present.

As demonstrated in FIG. 5, SID fragmentation on the rigid diamond target yielded a major $y_{13}$ structural fragment 510 corresponding to cleavage C-terminal to the aspartic acid (D) residue. Further, structurally significant b-ion fragments and informative internal fragments comprising arginine (R), proline (P), and both histidine (H) residues at the N-terminus were formed at higher fragmentation energies. Accurate mass data was again provided by the presence of the parent precursor 500 at all selected energies. Fragment results using SID in conjunction with the diamond target again show a distribution of structure-specific fragments and distribution of energies exhibiting wide sequence coverage, strong evidence of the mixing of both the high- and low-energy dissociation channels.

For purposes of showing the capability of the present method, peaks observed at m/z ratios corresponding to characteristic structure-specific fragments in the SID spectra were matched against a database of potential fragments predicted from peptide fragmentation in a mass spectrometer. For example, fragments were compiled using Protein Prospector 4.0 (hftp://prospector.ucsf.edu/ucsfhtml4.0/msprod.htm), a tool developed at the University of California San Francisco for calculating and selecting fragment ion candidates anticipated from fragmentation of a peptide in a mass spectrometer. The tool is illustrative of the many and varied searching tools, databases, libraries, and/or search engines that may be employed in analysis of biopolymers and biomaterials. Various alternatives in candidate databases and/or sequencing libraries may be used as would be known in the art, including, for example, MASCOT or SEQUEST for peptide and protein identification. Thus, no limitation in spectral libraries or choices of databases suited to proteomics or other classes of molecules is intended by disclosure of the tools used or disclosed herein.

For peptides tested in conjunction with the present invention, peak data for FT-ICR MS spectra in FIGS. 4-5 as a function of m/z ratios were compared against peak lists of candidates of all possible fragments and compiled for subsequent sequencing of the peptides.

Figure 6:
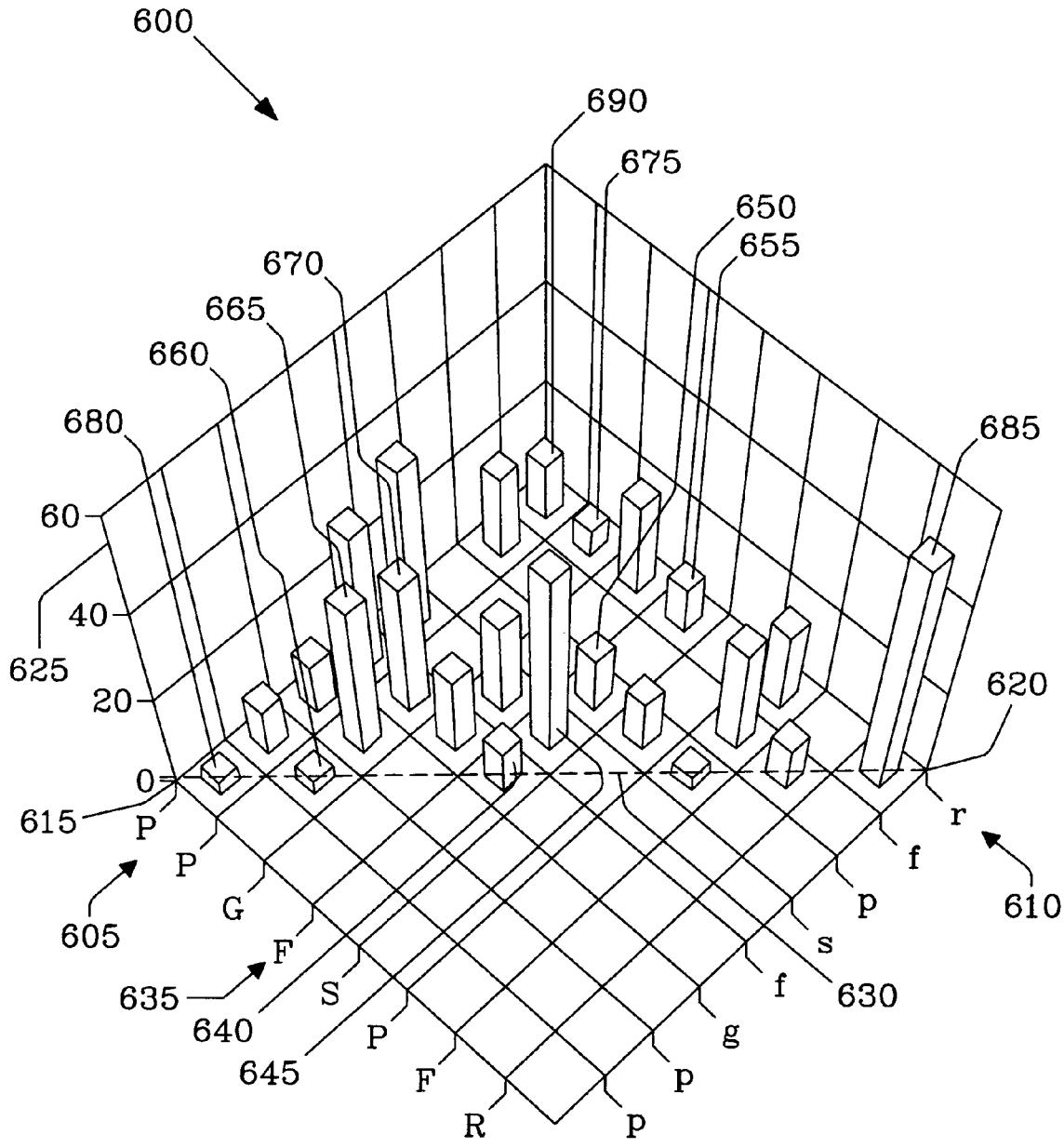
FIG. 6 presents a three-dimensional backbone fragmentation map compiled using SID fragmentation data from the 55-eV SID spectrum for des-Arg$^1$-bradykinin (SEQ. ID. NO: 1) presented in FIG. 4, showing percentages of N-terminal ion fragments and C-terminal ion fragments.

Sequencing of the backbone structures of parent peptides tested in conjunction with the invention will now be described with reference to FIGS. 6-7 using sequence-specific data derived from FIGS. 4-5, performed in conjunction with use of three-dimensional fragment mapping. FIG. 6 illustrates a detailed three-dimensional backbone fragment map 600 compiled from high-energy SID spectra at 55 eV of des-$ARG^1$-bradykinin (SEQ. ID. NO: 1). In FIG. 6, arrows 605 and 610 correspond to rows representing N-terminal amino acid residues in fragment sequences and C-terminal amino acid residues in fragment sequences, respectively. N-terminal fragments comprising any of the residues from 1 to n of an intact peptide having n-total residues are represented along the x-axis, with fragments having the first N-terminal residue (P) 615 in the sequence of a peptide appearing at a coordinate left-most along the x-axis. C-terminal fragments are presented along the y-axis from 1 to n, with fragments comprising the last C-terminal amino acid residue (r) 620 in the sequence of the peptide appearing at a coordinate right-most along the y-axis. For illustration purposes only, N-terminal residues are labeled using capital letters; C-terminal residues are labeled using lower-case letters. Peak intensities are plotted along the z-axis 625. Line 630 along the diagonal of the XY plane represents the expected position of immonium ions.

Map operation will now be described. As an example, all fragments (fragment ions) that begin with the phenylalanine (F) residue 635 are represented as dark-colored bars with bar 640 located at the junction of rows F and f and crossing line 630, thus corresponding to the immonium ion of phenylalanine (F). In the same row, bar 645 located at the junction of the F and s rows corresponds to the internal fragment FS, representing amino acids 4-5 of SEQ. ID. NO: 1. Bar 650 corresponds to the fragment FSP, representing amino acids 4-6 of SEQ. ID. NO: 1. Bar 655 located at the junction of the F and r rows corresponds to the $y_5$ fragment ion. In a second example, bar 660 located at the cross-over of rows P and p represents the immonium ion of proline (P), bars 665 and 670 represent internal fragments PG and PGF, respectively, that correspond to amino acids 2-3 and 2-4, respectively, of SEQ. ID. NO: 1, with bar 675 located at the junction of rows P and r representing the $y_7$ fragment.

To clarify the information contained in FIG. 6, bars 680 and 685 located in the corners along line 630 include combined abundances of all $b_1$ or $y_1$ fragment ions as well as the corresponding immonium ions. Thus, for example, bar 685 located at the junction of rows R and row r, represents the combined intensity of the $y_1$ and R fragment ions. Because a $b_1$ fragment ion was not observed in the instant SID spectrum, bar 680 located at the junction of Rows P and p represents only the normalized abundance of the immonium ions of proline (P). A similar approach was used to represent abundances of all other fragment ions that formally correspond to the same sequence. For example, intensities of the $b_4$, $a_4$, and $a_4$–18 ($a_4$ minus 18) fragment ions were added together to represent the overall abundance of all fragments arising from the PPGF sequence (corresponding to amino acids 1-4 of SEQ. ID. NO: 1). Finally, bar 690 located at the junction of the first P and r rows in the corner of FIG. 6 represents the combined abundance of fragment ions corresponding to loss of small molecules from the precursor ion.

Graphic representation of the information content in FIG. 6 from high-energy SID spectra of des-$Arg^1$-bradykinin (SEQ. ID. NO: 1) indicated formation of a nearly complete series of sequence-specific N-terminal fragments (e.g., $b_n$ and $b_n$–$NH_3$ ions), a good series of y-fragments, and a large number of internal fragments consisting of from 2-3 amino acid residues. The backbone fragment information gleaned from the SID spectra allowed for the accounting of greater than 90% of the overall SID fragmentation in one chart. In addition, the presence of the intact precursor ion in the spectrum was advantageous for peptide identification given the known mass of the precursor ion.

Figure 7:
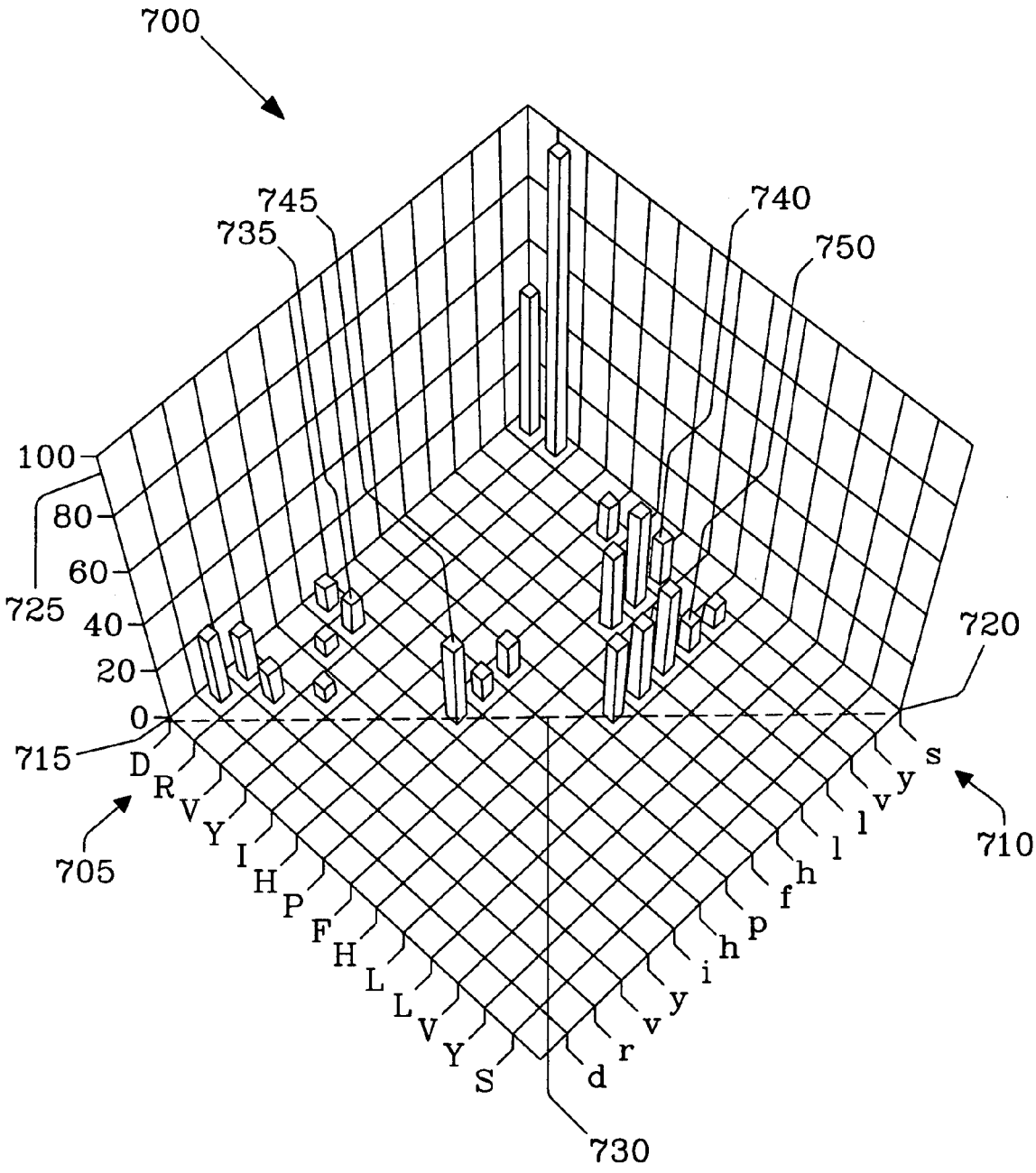
FIG. 7 presents a three-dimensional backbone fragmentation map compiled using SID fragmentation data from the 55-eV SID spectrum for renin substrate tetradecapeptide porcine (SEQ. ID. NO: 2) presented in FIG. 5, showing percentages of N-terminal fragments and C-terminal fragments.

FIG. 7 presents a three-dimensional backbone fragmentation map 700 for fragment ions observed in high-energy SID spectra at 75 eV of renin substrate tetradecapeptide porcine (SEQ. ID. NO: 2). Arrows 705 and 710 point to rows corresponding to N-terminal ion fragment sequences and C-terminal ion fragment sequences, respectively. As in FIG. 6, N-terminal fragment sequences comprising any residues from 1 to n of an intact peptide having n-total residues are represented along the x-axis, with fragments having the first N-terminal residue aspartic acid (D) 715 in the sequence of a peptide appearing at a coordinate left-most along the x-axis. C-terminal fragment sequences are represented along the y-axis from 1 to n, with fragments comprising the last C-terminal amino acid residue (s) 720 in the sequence of the peptide appearing at a coordinate right-most along the y-axis. Again, as in FIG. 6, for illustration purposes, N-terminal residues are labeled using capital letters; C-terminal residues are labeled using lower-case letters. No limitation is thereby intended. Peak intensities are plotted along the z-axis 725. Line 730 along the diagonal of the XY plane corresponds with the expected position of immonium ions. Operation of the map represented in FIG. 7 is as described previously for FIG. 6.

The major fragment observed for renin substrate tetradecapeptide corresponds to a selective cleavage C-terminal to the aspartic acid (D) residue (i.e., amino acid 1 of SEQ. ID. NO: 2) resulting in formation of the $y_{13}$ fragment. In addition, as shown by map 700, high-energy SID on diamond target 190 produced several small b-fragments, and a very informative series of internal structure-specific fragments, i.e., 735, 740, 745, and 750 at the N-terminus with arginine (A), as shown beginning at the crossover of rows R and r, with proline (P) as shown beginning at the crossover of rows of P and l, and with both histidine (H) residues, respectively. Results again demonstrate SID on a diamond target provides rich structural information important for characterization of complex molecules.

The greater yields of structure-specific fragments formed using diamond SID are believed to be a function of 1) a wide distribution of internal energies deposited into ions by collisions with the diamond target, 2) new fragmentation channels opened as a direct consequence of dissociation on the diamond target, and 3) efficient mixing of both slow and fast fragmentation or dissociation pathways. Surface-induced dissociation of MALDI-generated peptides ions in a FT-ICR mass spectrometer incorporating a rigid diamond film target has demonstrated unique utility for generating structure-specific fragments having enhanced sequence coverage for sequencing and identifying peptides. Results demonstrate that SID in conjunction with a rigid diamond target provides better sequence coverage for complex molecules that are inherently difficult to fragment using techniques known in the art. For example, activation of MALDI-generated ions by collisions with the diamond target in conjunction with FT-ICR MS is a powerful method for characterization and identification of complex molecules. Efficient mixing of slow and fast fragmentation channels provides excellent control over sequencing patterns derived from SID data in any MS or tandem MS experiment. In addition, the presence of precursor ions in the SID fragment spectra provided both an accurate mass determination of the precursor and the sequence-specific fragment data for sequencing the precursor in a single experiment.

While the present invention has been described herein with reference to the preferred embodiments thereof, it should be understood that the invention is not limited thereto, and various alternatives in form and detail may be made therein without departing from the spirit and scope of the invention. In particular, those skilled in the art will appreciate that reference to large molecules herein in conjunction with the present invention, may include many related moieties, like chemical products, and/or intermediates can be equally sequenced. No limitation in the types of large molecular products that can be sequenced is intended by the disclosure of the molecules herein.

SEQUENCE LISTING

```
<160> NUMBER OF SEQ ID NOS: 2

<210> SEQ ID NO 1
<211> LENGTH: 8
<212> TYPE: PRT
<213> ORGANISM: Homo sapiens

<400> SEQUENCE: 1

Pro Pro Gly Phe Ser Pro Phe Arg
1               5


<210> SEQ ID NO 2
<211> LENGTH: 14
<212> TYPE: PRT
<213> ORGANISM: Porcine

<400> SEQUENCE: 2

Asp Arg Val Tyr Ile His Pro Phe His Leu Leu Val Tyr Ser
1               5                   10
```

We claim:

1. A process for enhanced sequencing of a complex molecule utilizing a mass spectrometer, said method comprising the steps of:

impacting an ion beam comprising at least one precursor molecule against a preselected target at a preselected collision energy, said preselected target having a diamond film positioned in a location whereby when said ion beam impacts against said diamond film said at least one precursor molecule separates into a plurality of structure-specific, sequence-identifying fragments;

analytically identifying residues present within said structure-specific, sequence-identifying fragments over a sequence coverage mass range;

reconstructing the original sequence of residues present in said at least one precursor molecule from the analytically identified fragment residues; and identifying said at least one precursor molecule.

2. The process of claim 1, wherein said at least one precursor molecule is selected from the group consisting of polymers, biopolymers, biomaterials, biomolecules, proteins, peptides, polypeptides, saccharides, polysaccharides, nucleic acids, oligonucleotides, DNAs, RNAs, PNAs, and combinations thereof.

3. The process of claim 1, wherein said mass spectrometer is selected from the group consisting of FT-ICR instruments, tandem instruments, time-of-flight instruments, ion-trap instruments, quadrupole instruments, sector instruments, and combinations thereof.

4. The process of claim 1, wherein said at least one precursor molecule is introduced to said ion beam by an ionization method selected from the group consisting of matrix-assisted laser desorption/ionization, electrospray ionization, sonic-spray ionization, fast-atom-bombardment ionization, atmospheric-pressure ionization, liquid-ionization-from-droplets ionization, field-desorption ionization, laser-desorption ionization without a matrix, and combinations thereof.

5. The process of claim 1, wherein the step of impacting said ion beam on said target includes impacting said ion beam at a surface-normal incidence.

6. The process of claim 1, wherein the step of impacting said ion beam on said target includes impacting said ion beam at an incidence angle with respect to the target surface normal vector in the range from about 0 degrees to about 90 degrees.

7. The process of claim 1, wherein the step of impacting said ion beam includes collision energies for surface-induced dissociation in the range from about 10 eV to about 150 eV.

8. The process of claim 1, wherein the step of reconstructing the original sequence of residues of said at least one precursor molecule includes plotting peak intensities of N-terminal residues, and C-terminal residues, of said sequence-identifying fragments as a function of residue position along respective axes of a single three dimensional display and analytically coordinating same to deduce the sequence of residues of said at least one precursor molecule.

9. The process of claim 1, wherein said structure-specific sequence identifying fragments are fragments comprising structurally connected residues selected from the group consisting of: amino acids, nucleotides, monosaccharides, nucleic acid monomers, polymer monomers, PNA monomers, DNA monomers, and RNA monomers.

10. The process of claim 9, wherein said structure-specific, sequence identifying fragments are fragments comprising of from 1 to (n) residues of said at least one precursor molecule, where (n) is the number of residues in the sequence of said at least one precursor molecule.

11. The process of claim 10, wherein said fragments include 1 residue in the sequence of said at least one precursor molecule.

12. The process of claim 11, wherein said fragments are immonium ion fragments.

13. The process of claim 10, wherein said fragments are internal fragments.

14. The process of claim 10, wherein said structure-specific sequence identifying fragments comprise at least 2 connected residues in the sequence of said at least one precursor molecule.

15. The process of claim 10, wherein said structure-specific sequence identifying fragments comprise at least 3 connected residues in the sequence of said at least one precursor molecule.

* * * * *